US006547509B1

(12) United States Patent
Edmo

(10) Patent No.: US 6,547,509 B1
(45) Date of Patent: Apr. 15, 2003

(54) LIFTING DEVICE WITH A LIFTABLE AND TILTABLE PLATFORM

(75) Inventor: Torbjörn Edmo, Härnösand (SE)

(73) Assignee: Edmolift AB, Harnosand (SE)

( * ) Notice: Subject to any disclaimer, the term of this patent is extended or adjusted under 35 U.S.C. 154(b) by 0 days.

(21) Appl. No.: 09/529,489

(22) PCT Filed: Sep. 24, 1998

(86) PCT No.: PCT/SE98/01718

§ 371 (c)(1),
(2), (4) Date: Apr. 14, 2000

(87) PCT Pub. No.: WO99/20560

PCT Pub. Date: Sep. 24, 1998

(30) Foreign Application Priority Data

Oct. 17, 1997 (SE) ..... 9703795

(51) Int. Cl.[7] ..... B66F 7/22

(52) U.S. Cl. ..... 414/639; 414/590; 414/917; 414/921; 414/642; 414/495; 254/10 R; 187/269

(58) Field of Search ..... 414/917, 921, 414/589, 590, 639, 640, 641, 642, 662, 663, 668, 495, 678; 187/216, 269; 254/10 R, 10 B, 10 C

(56) References Cited

U.S. PATENT DOCUMENTS

| | | | | |
|---|---|---|---|---|
| 2,785,807 A | * | 3/1957 | Prowinsky | 414/589 |
| 4,636,133 A | * | 1/1987 | Hess | 414/917 X |
| 4,780,044 A | * | 10/1988 | Elskamp | 414/917 X |
| 5,230,522 A | * | 7/1993 | Gehlsen et al. | 414/921 X |

FOREIGN PATENT DOCUMENTS

| | | |
|---|---|---|
| EP | 0749925 | 12/1996 |
| FI | 53930 | 5/1978 |
| GB | 2 254 310 | 10/1992 |

* cited by examiner

*Primary Examiner*—Frank E. Werner
(74) *Attorney, Agent, or Firm*—Sughrue Mion, PLLC

(57) ABSTRACT

This invention relates to a lifting device for low-weight loads, and may have a lift and tilt arrangement comprising one single lift arm and one single tilt arm. In that case those arms can either be located centrally in relation to the platform or at one of its sides.

Figure 1:
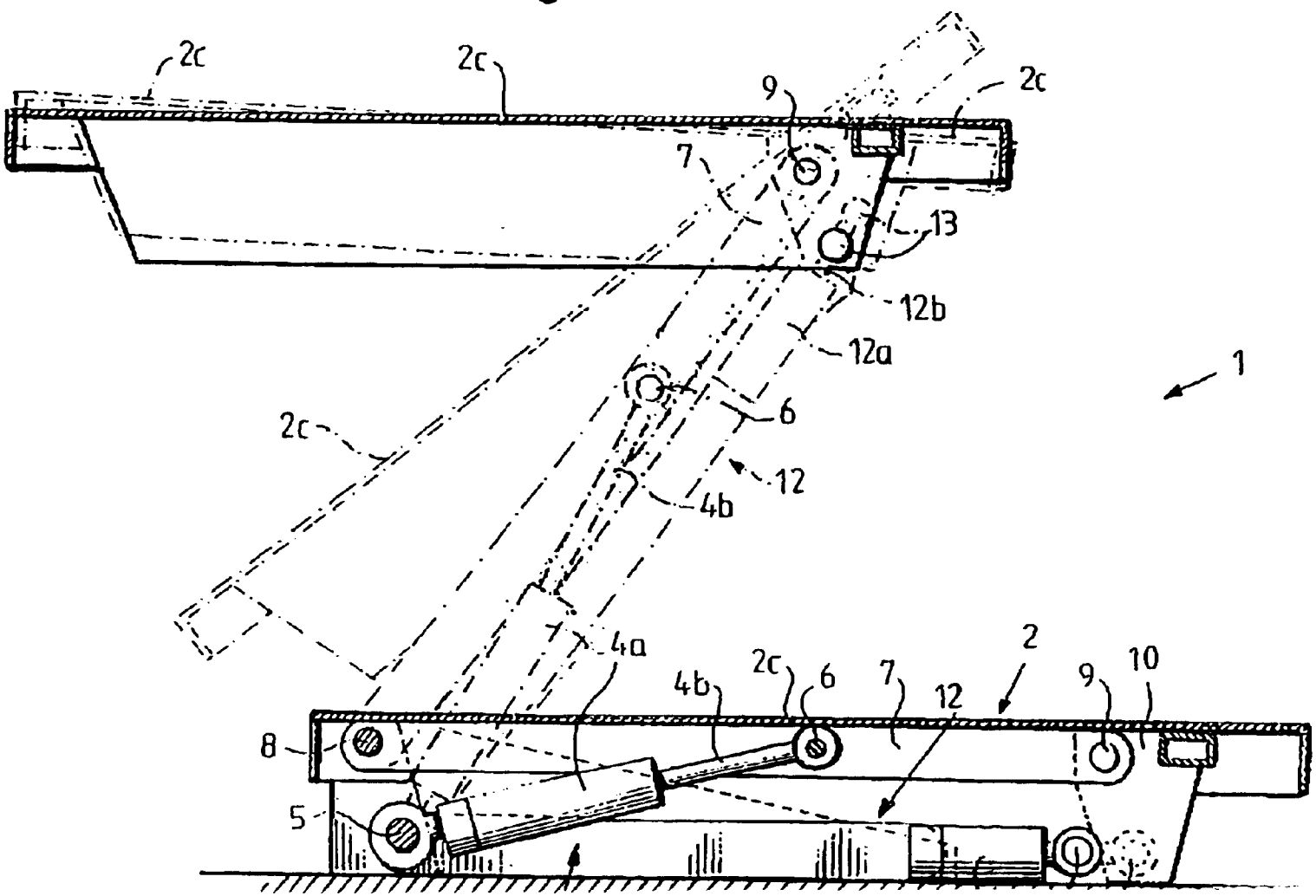

Two lift arms and two tilt arms together may be used with related link arms, those lift and tilt arms then being suitably journalled on a common horizontal shaft and the link arms on another horizontal shaft, those two shafts extending transversely to the load-supporting portion of the platform.

8 Claims, 2 Drawing Sheets

1
2
2c
2c
2c

LIFTING DEVICE WITH A LIFTABLE AND TILTABLE PLATFORM

FIELD OF THE INVENTION

The present invention relates to a lifting device for pallets or any other, arbitrary load.

Such lifting devices may be used in many different fields for the lifting of loads of various kinds and for a related tilting of the platform.

SUMMARY OF THE PRIOR ART

It is common to use lifting tables which as a rule are provided with different types of hydraulically actuated scissor-links but generally not designed so as to permit tilting of the lifting table. In such cases where tilting was desired a special tilting unit was as a rule attached to the table, which makes the structure more complicated and expensive.

An inconvenience from which all prior art lowrise lifting tables have suffered is that it has not been possible to lower the load surface sufficiently deep towards the floor which has limited their usefulness, particularly in such cases where it has been desired to have the possibility to roll up some type of cart or the like on the table or lifting platform.

As far as the lifting of pallets is concerned it has as a rule been possible to handle pallets of normal Swedish standard, e.g. as use by the Swedish State Railways, with simultaneous use of pallet carts available on the market. However, the handling of pallets of other types, e.g. so called sea pallets according to British standard, has involved problems which so far have not been overcome in a satisfactory manner, i.a. due to the fact that it has not been possible to lower the lifting table or platform, respectively, sufficiently deep towards the floor surface.

Liftable and tiltable load platforms are also widely used in so called truck rear end lifts for vehicles. In that case the frame structure and the related lift arms and tilt arms are supported by the vehicle and it is obvious that such a device cannot be used for the purpose here at issue, to provide a lifting table or lifting device having a frame structure resting on a floor surface or the like.

FI,B,53930 (Venäläinen) describes a service and straightening bench for motorcars which is arranged to perform a working movement necessary for straightening the car body between a work unit attached to the frame portion of the straightening bench and the car body secured to lateral beam mounts. Due to its special function this lifting device has accomplicated layout and cannot advantageously be used for the above-mentioned, in the present context applicable purpose.

GB,A,2 254 310 (The UK Lift Company) discloses a lifting device provided with scissor-links which lifting device is not tiltable and consequently exhibits the above-mentioned drawbacks associated therewith.

Some further examples of the standing of the prior art are to be found in EP,A,0 749 925 (Himecs), GB,A,2 188 610 (Gerhard Finkbeiner) and DE,B,1 106 942 (Maschinen-Trepel).

THE OBJECT OF THE INVENTION

For the above reasons it is an object of the present invention to avoid the shortcomings of the previously known lifting devices and lifting tables by making possible the addition of a tilt function as an integrated portion of the lifting device.

Another object of the invention is to provide a lifting device having a load platform which, in response to the field in use in question or to desired properties, can be arranged so that the main portion of the load platform can assume a lower position close to the floor surface or a position at a distance thereabove.

A further object is to provide a lifting device permitting tilting and being in the shape of a simple and solid unit which conveniently can be moved to different places for use and permits tilting in different directions from a horizontal position, the permitted tilting in the one direction preferably covering a greater angular area than in the other direction.

A still further object is to provide a lifting device making it possible conveniently to roll up onto the load platform, e.g. a cart or a wheel-chair and comprising a stop member, so that in the lower position of the lifting device the cart or wheel-chair cannot unintentionally roll off the platform in the mounting direction.

SUMMARY OF THE INVENTION

The above and other objects are satisfied by a lifting device according to the invention.

Thanks to the arrangement of the pivot shafts of the lift arm, the link arm and the tilt arm, respectively, the link arm and the tilt arm being connected to the platform and the link arm and the tilt arm oriented in the way mentioned above in the lower position of the platform, there is offered a possibility to design the load platform so that its load-supporting portion can be lowered to contact with or a very small distance from the floor surface, the lift and tilt mechanism at the same time being protected by another portion of the load platform or, alternatively, the load platform can in the shape of a substantially flat board, similar to a scissor lift table in its lower position be located at a desired distance from the floor surface.

In both cases the tilting function of the load platform is attained without any additional superstructure on the lifting device, meaning that the lowest height possible is maintained.

In practice it is preferred—according to both alternatives—that when the platform is in said lower position, at least the main portion of the lift arm, the link arm and the tilt arm are located below a upper platform portion.

In this respect there exists a substantial difference in comparison with truck rear end lifts, at which the main portion of the lift and tilt arms are located outside the platform when it is in its lower position.

Suitably, the lift arm and the tilt arm are journalled on coinciding shafts in the frame.

A lowrise lifting device of the kind defined above is further characterized in that in the lower position of the platform the major portion of its load-receiving surface is essentially level with or at a small distance from the floor surface or the lower portion of the frame, whereas another portion of the platform does partly enclose the lift and tilt arms.

In that case the enclosing platform portion suitably has the shape of an inverted U.

A lifting device according to the invention , especially for low-weight loads, may have a lift and tilt arrangement comprising one single lift arm and one single tilt arm. In that case those arms can either be located centrally in relation to the platform or at one of its sides.

However, as a rule it is preferred to use two lift arms and two tilt arms together with the related link arms, those lift and tilt arms then being suitably journalled on a common horizontal shaft and the link arms on another horizontal shaft, those two shafts extending transversely to the load-supporting portion of the platform.

In this way there is provided a rigid and stable lifting device which inspite of its comparatively small dimensions can handle heavy loads.

In a lowrise lifting device of the kind defined above, in the lower position of the platform, both shafts extend above the level of the load-receiving portion of the platform. Further, at each of the lateral edges of the load-receiving portion a portion of the platform does partly enclose the respective pair of lift and tilt arms.

Further characteristics of and advantages with the lifting device according to the invention will appear from the description below of some embodiments thereof. The description connects with the annexed diagrammatic drawing figures.

SUMMARIZED DESCRIPTION OF THE DRAWING FIGURES

FIG. 1 is a vertical section through a lifting device according to the invention and does in solid lines show a lower and an upper horizontal position for the load platform of the lifting device and, in dash-dot lines, the load platform in two tilted positions, namely one tilted about 45° downwards and one tilted about 5° upwards. Also the lift and tilt arms of the lifting device have been shown in dash-dot lines in the upper, horizontal position of the platform.

Figure 2:
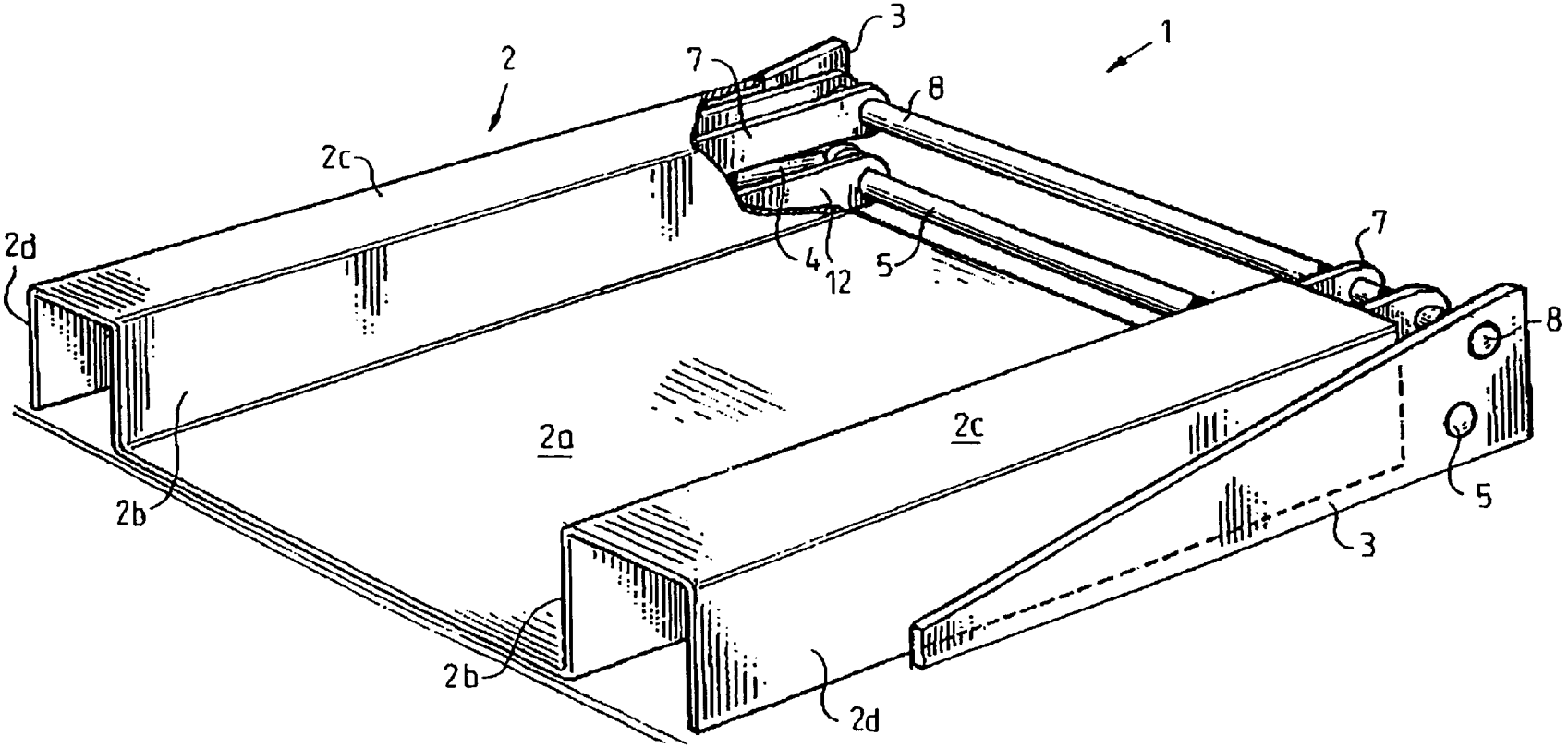

FIG. 2 is a perspective view, partly in section, showing the lifting device according to FIG. 1 in its lower position.

DESCRIPTION OF PREFERRED EMBODIMENTS

In the drawing numeral 1 generally designates a lifting device with a liftable and tiltable platform 2, which device can be used for a plurality of different purposes.

The lifting device according to the embodiment illustrated has a frame which is supported by a floor and consists of two roughly triangular beam elements 3 on either side of the load platform 2. The beam elements 3 of the frame are interconnected by transverse shafts 5 and 8, respectively, at different levels, which are connected to the lift, tilt and link arms of the lifting device in a manner below described in detail.

Secured to the horizontal shaft 5 journalled in the frame 3 there is a pivotable lift arm 4, a substantial portion of which consists of a cylinder unit with a lift cylinder 4*a* and a piston rod 4*b*. Piston rod 4*b* is in its turn via a pivot shaft 6 connected to two parallel link arms 7 and, more specifically, slightly offset from their centers. Via pivot shaft 8 link arms 7 have their one end connected to frame 3. Link arms 7, extending on both sides of lift arm 4, are each at the other end via a shaft 9 connected to a downwards projecting mounting piece 10 located at the bottom side of the load platform 2.

The horizontal shaft 5 further supports a pivotable tilt arm, generally designated 12, which at its one end comprises one portion on each side of the lift arm 4, those portions in one of its ends supporting a tilt cylinder 12*a* having a piston rod 12*b*. Tilt arm 12 is via a shaft 13 pivotably connected with the above-mentioned mounting piece 10.

Consequently, the common pivot shaft 5 for the lift arm 4 and the link arm 7 and the pivot shaft 8 for the tilt arm 12 are located in the area at the one end of frame 3, whereas link arm 7 and tilt arm 12 are connected to the platform 2 in the area at the opposite end thereof.

In the lower position of the load platform 2 link arm 7 and tilt arm 12 extend horizontally and parallel to each other with a vertical spacing between them. Link arm 7 extends closely below a portion 2*c* of the load platform 2. Tilt arm 12 extends closely above the floor surface and may, if desired, be in contact therewith.

The lifting movement of the lifting device is initiated in the way that a hydraulic fluid is supplied to the cylinder 4*a* of the lift arm 4 causing an outward displacement of piston rod 4*b*. This will cause link arm 7 to pivot around the journalled point 8, so that the load platform 2 is lifted to the upper horizontal position shown in FIG. 1 in solid lines. The lifting movement is stabilized by the tilt arm 12 which—like the lift arm 4—pivots around the shaft 5. In the upper position of platform 2 link arm 7 and tilt arm 12 still extend parallel to each other at an inclination of about 55° relatively the horizontal plane. Tilting of platform 2 from its horizontal position can now be accomplished by draining of the pressurized fluid from the tilt cylinder 12*a*. In FIG. 1 there has in dash-dot lines also been shown a position in which the lift platform 2 is tilted about 45° relatively the horizontal plane.

It is also possible alternatively to tip the lift platform 2 slightly upwards, namely about 5°, which also has been shown in dash-dot lines in FIG. 1. The tilting upwards is achieved in the way that hydraulic fluid is supplied to the tilt cylinder 12*a*, so that its piston rod 12*b* will move inwards to its innermost position.

The possibility of tilting in a lifting device according to the invention is a considerable advantage in many cases, by way of example in comparison with prior art lifting tables consisting of scissor-links, at which such a tilting normally is not possible or requires the addition of an extra tilting unit on top of the table.

In the embodiment shown the load surface 2*a* is in the lower position of the load platform 2 located close to the floor surface. In practice the load surface can be a few millimeters above the floor. This has been made possible thanks to the fact that the lift and tilt arms 4, 12 and their related cylinder units 4*a*, 4*b*, 12*a*, 12*b* are located on the side of the load-receiving portion 2*a* of the platform. The above-mentioned lift, tilt and link arms are then in the lower position enclosed by the load platform lateral portions 2*b*, 2*c*, 2*d* shaped like an inverted U. Those lateral portions do at the same time offer protection of the arms and the related cylinder units.

An important advantage gained thanks to this structural design of the load platform is that it becomes possible to push e.g. a pallet cart or a wheel-chair up on the load platform when in its lower position and thereafter perform the desired lifting movement, succeeded by a tilting movement, if desired.

Further, a load platform 2 of the type defined is suitable to match a so called sea pallet designed according to British standard, which is difficult using existing lifting carts. Also, the shape of the load platform including its bent configuration renders it stable.

It is, however, also possible to design the load platform in another way, e.g. so that the main portion of the load platform is located in the same level as the horizontal surfaces 2*c* according to the embodiment illustrated. In that case the lateral edge portions can be bent downwards, if desired.

The load platform can also be designed in other ways, e.g. to match a pallet according to the standards of the Swedish State Railways.

The desired lift and tilt functions can be achieved by modification of the end connections of the lift and tilt arms. In this way different demands can be excellently satisfied.

In response to the dimensions of the lifting device its lifting capacity may vary within wide limits. By way of example, at a standard size simple to handle the lifting capacity could be 1500 kgs and the tilt range may vary within the above-mentioned limits, meaning about 45° downwards and 5° upwards. In an upper position the tilting ability can be utilized in many ways, for instance to initiate a rolling movement of a cart or some other product lifted by the platform. Also, the lifting device can be used to lift a roller conveyor for passage to a rail system. Further, the lifting device can receive pallets, e.g. from a roller conveyor, and lower them to the floor, in which connection the tilting device can be helpful both as a stopping means and to initiate rolling.

In the lower-position shown in the drawing the transverse shafts 5 and 8 may serve as a stopping means when e.g. a pallet cart, a wheel-chair or the like is pushed up. When a lifting movement has been carried out, the loading surface 2*a* will be located above the level of shafts 5 and 8, thus offering a possibility to continue the movement out from the load surface in the direction of entry.

The frame can be designed in many different ways to satisfy the intended use of the device. Accordingly, the frame can e.g. be secured to a wall or to some type of movable unit, for example a cart, whereby the lifting device can conveniently be moved.

Especially in the case of smaller lifting devices it could be sufficient to use one tilt and one lift arm along with the related cylinder units. The tilt arms could then be mounted at the one side of the lifting device, but it is also possible to locate them centrally, e.g. so that the load platform does centrally support a projecting portion with a profile of an inverted U.

What is claimed is:

1. A lifting device having a liftable and tiltable platform, said lifting device comprising:

a) a frame, supported at a lower portion thereof by a floor surface, b) a lift arm comprising a cylinder unit for changing the length of the lift arm and having one end swingably journalled in the frame via a joint point, c) a link arm having one end swingably mounted in the frame, and having another end swingably connected, via a first mounting piece joint point, to a mounting piece projecting downwards from the platform, another end of the lift arm being connected to the link arm in a joint point disposed between the joint points at the one end and the other end of the link arm, d) a tilt arm comprising a cylinder unit for changing the length of the tilt arm, having one end swingably journalled in the frame, and having another end connected via a second mounting piece joint point in the mounting piece, whereby the tiltable platform is tiltable about the first mounting piece joint point;

wherein:

e) swinging axes of the lift arm, the link arm, and the tilt arm, respectively, are located in a zone in proximity to one end of the frame, f) in a bottom position of the platform, the link arm and the tilt arm are both connected to the platform in a zone in proximity to an end of the platform opposite the one end of the frame, and g) in said bottom position of the platform, the platform has a horizontal orientation, and the link arm and the tilt arm extend substantially horizontally and parallel to each other, the link arm assuming the uppermost position.

2. A lifting device according to claim 1, characterized in that, in said bottom position of the platform, at least the main portion of the lift arm, the link arm and the tilt arm are located below an upper platform portion.

3. A lifting device according to claim 1, characterized in that the lift arm and the tilt arm are journalled in the frame on identical shafts.

4. A lifting device according to claim 1, wherein:

the platform has a load supporting surface, and in said bottom position of the platform:

the load supporting surface is substantially level with the lower portion of the frame, and another portion of the platform does partly enclose the lift and tilt arms.

5. A lifting device according to claim 4, characterized in that the enclosing portion of the platform is generally shaped like an inverted U.

6. A lifting device according to claim 1 and comprising two lift, two tilt, and two link arms, the platform having a load supporting surface, characterized in that the two lift arms and the two tilt arms are journalled in the frame on a common horizontal shaft, and the two link arms on another horizontal shaft.

7. A lifting device according to claim 6, wherein, in the bottom position of the platform,:

said both shafts are located above the level of the load supporting surface of the platform, a portion of the platform partly encloses the two lift arms and the two tilt arms, and the two lift arms and the two tilt arms are disposed at lateral ends of the load supporting surface of the platform.

8. A lifting device according to claim 1, characterized in that the lift arm and the tilt arm are journalled in the frame on coinciding shafts.

* * * * *